United States Patent [19]

Grieger et al.

[11] Patent Number: 4,673,842

[45] Date of Patent: Jun. 16, 1987

[54] GRAPHITE CATHODE CUP FOR GRIDDED X-RAY TUBES

[75] Inventors: Ronald D. Grieger, New Berlin; Sepehr Fariabi, Milwaukee; Joshua O. Kolawole, Wauwatosa, all of Wis.

[73] Assignee: General Electric Company, Milwaukee, Wis.

[21] Appl. No.: 771,696

[22] Filed: Sep. 3, 1985

[51] Int. Cl.[4] ..... H01J 1/48; H01J 35/04; H01J 9/14

[52] U.S. Cl. ..... 313/292; 313/310; 313/311; 313/352; 378/193; 445/29

[58] Field of Search ..... 313/37, 38, 292, 310, 313/334, 456, 458, 447, 338, 311, 352; 378/134, 193, 203; 445/28, 29

[56] References Cited

U.S. PATENT DOCUMENTS 2,683,236 7/1954 Rawls et al. ..... 313/334 X 3,329,849 7/1967 Jones ..... 313/37 X 4,220,889 9/1980 Marhic et al. ..... 313/38

*Primary Examiner*—David K. Moore

*Assistant Examiner*—K. Wieder

*Attorney, Agent, or Firm*—James H. Beusse; Douglas E. Stoner

[57] ABSTRACT

A cathode cup structure for a high voltage x-ray tube having a base formed of a weldable material and an exposed upper surface of a non-weldable material bonded to the base. The upper surface may be machined from a block of graphite to form an appropriate cathode cup structure configuration and then bonded to a base formed of TZM using a platinum brazing compound. The graphite upper surface may be coated with pyroltic carbon to reduce dust or alternatively, may be formed of a composition of silicon carbide graphite to minimize dusting problems. The graphite composition of the upper section of the cathode cup minimizes the risk of welding of an electron emissive filament passing through the cup structure.

13 Claims, 2 Drawing Figures

GRAPHITE CATHODE CUP FOR GRIDDED X-RAY TUBES

BACKGROUND OF THE INVENTION

The present invention relates to electrodes for high-voltage electron beam tubes and, more particularly, to cathode cups for such tubes.

In high-voltage electron beam tubes such as, for example, x-ray tubes, an electron emitter or cathode is generally caused to emit electrons by a combination of relatively high voltage and heat. Control of emission of electrons may be by use of a "grid" whose potential with respect to the electron emitter may be varied to either accelerate or retard an electron beam. In an x-ray tube, the cathode may comprise a filament which is heated by electrical current to emit electrons and a surrounding cathode cup which acts as a grid to control electrons emitted by the filament. The cathode cup generally has one or more slots within which the filament, in the shape of a helical coil of wire, is positioned. Power is applied to the filament in order to force a heating current for generating electron emission.

The electrons emitted by the filament are controlled by voltage applied to the cathode cup. The potential between the filament and cathode cup may be several thousand volts. Accordingly, any contact between the filament and cathode cup may result in an electrical arc and welding of the filament to the cup at the point of contact thereby short-circuiting the filament and cup and resulting in uncontrolled electron emission. Unfortunately, such short-circuiting occurs relatively frequently as the filament is prone to move due to vibration created either mechanically by tube motion or electrically by high voltage breakdowns between the filament and cathode cup.

It is an object of the present invention to provide an improved cathode cup for an electron beam tube which reduces the risk of filament to cathode welding.

It is another object of the invention to provide an improved cathode cup for an electron beam tube which cathode cup is formed of a non-weldable material.

SUMMARY OF THE INVENTION

In a preferred embodiment of the present invention a cathode cup for an electron beam tube is constructed as a composite cup having a weldable base section and a non-weldable upper section bonded together. The filament extends within a slot formed in the upper section. The base section is formed of a high temperature molybdenum alloy (TZM), which contains 0.5% titanium, 0.07% zirconium and approximately 0.05% carbon while upper section is formed of graphite. The two sections are brazed together to form a finished cup using a platinum or zirconium brazing material. In an alternate embodiment the upper section may be formed of a silicon carbide graphite material. In either embodiment, the surface of the upper section may be covered with pyrolytic carbon. Since the carbon based materials are essentially non-weldable, contact between filament and cup does not result in a weld even in the presence of arcing and thus avoids the shortcircuiting of the cathode-filament circuits.

DESCRIPTION OF THE DRAWING

For a better understanding of the invention reference may be had to the following detailed description taken in conjunction with the accompanying drawing in which.

DETAILED DESCRIPTION

Figure 1:
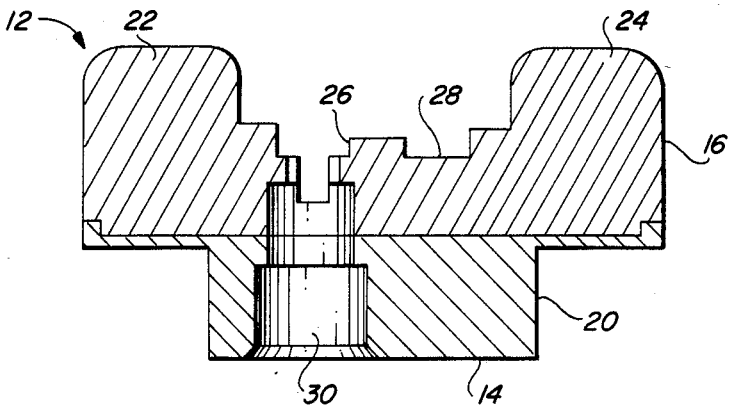
FIG. 1 is a side elevation view in cross-section of a cathode cup in accordance with the present invention.

Referring now to FIG. 1, there is shown a side elevation view in cross-section of a cathode cup for an x-ray tube constructed in accordance with the teachings of the present invention. The shape of the cathode cup is conventional and not considered a part of the present invention. Such cups are used in various types of x-ray tubes and may be constructed in other known shapes. The cathode structure comprises a focusing cup 12 in which there is an electron emissive filament (not shown) which serves to provide an electron beam that is attracted to an x-ray target during operation of an x-ray tube. The target will normally be at a high direct current potential relative to the cathode focusing cup 12. Typically, the potential of the cathode cup may be driven to a negative voltage potential of several thousand volts while the x-ray target may be driven to a positive voltage potential of several thousand volts. Within the cathode cup structure 12 the filament may be several thousand volts negative or positive with respect to the cathode cup 12.

Figure 2:
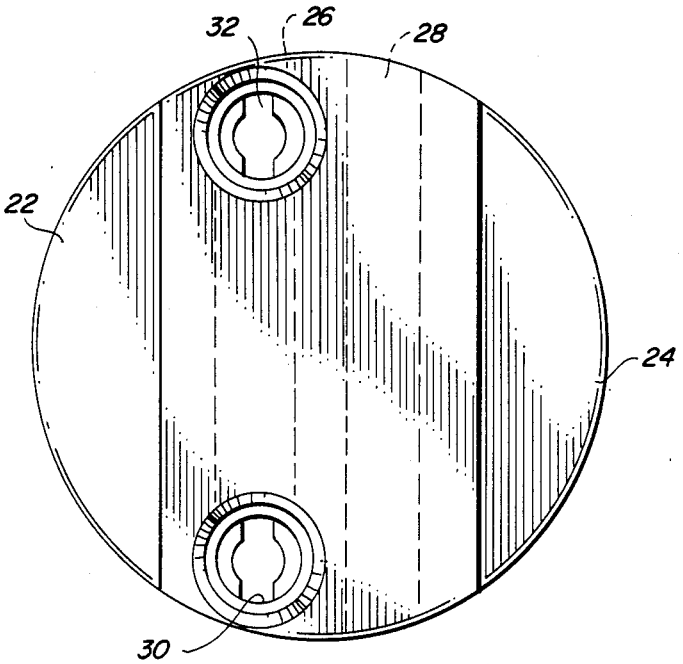
FIG. 2 is a top view of the cup of FIG. 1.

In describing the conventional structure of a cathode cup, reference will be made to FIGS. 1 and 2 concurrently. It will be seen that the cup 12 includes a lower base structure 14 which is somewhat narrower in cross-section than an upper cup section 16. The base structure 14 is narrowed to fit into a fork-shaped supporting member (not shown) of a type well known in the art for supporting cathode structures. The fork support structure may be welded to the base structure 14 along the edges 18 and 20. From an examination of FIG. 1 and FIG. 2, it will be seen that the upper structure 16 includes oppositely disposed raised areas 22 and 24 which define a channel passing through a central portion of the upper structure. Within the channel formed across the surface of the upper structure 16 are two additional channels 26 and 28. The emissive filaments (not shown) are positioned within the channels 26 and 28. As will be apparent from observing FIGS. 1 and 2, and the particular embodiment illustrated the channel 28 is superfluous in that it is not adapted to support a filament.

A filament winding is normally supported in the channel 26 between first and second stand-offs (not shown) positioned within the apertures 30 and 32 drilled through both the lower base section 14 and the upper section 16. The stand-offs are constructed in a manner well known in the art to insulate the filament from the cathode cup structure and to provide adequate support for stretching the filament between the two stand-offs so as to maintain it within the channel 26. Typically, the filament will comprise a helical coil of tungsten wire stretched between the stand-offs. In those instances in which a dual filament system is required, additional holes will be drilled through the base structure 14 and the upper structure 16 aligned with the slot 28 so as to provide additional supports for a second filament passing through the slot 28.

In a conventional cathode cup structure, the width of the slot 26 will be approximately $\frac{1}{8}$ inch. Accordingly, the spacing between a helical wound filament and the sides of the slot 26 is extremely small. During operation of the x-ray tube, cycling of the voltage on the cathode cup 12 creates a force on the coil of the filament. Abrupt removal of this force (such as may result from arcing in the grid circuit or in the space between filament and cup) may tend to cause the filament to vibrate and come in contact with the cup wall. Furthermore, thermal cycling of the wound filament may also cause the filament to flex and bend. For all of the above reasons, it is common for the filament to occassionally contact a sidewall of the slot such as that at 26. Typically, the potential between the filament and the sidewall may be in the order of 4,000 volts. Such voltage differential will tend to cause an arc to be drawn between the filament and the sidewall at a point of contact and in many instances, will result in the filament being welded to the sidewall of the slot 26. Such welding will result in damage to the cathode cup and the drive circuits for the filament and cathode cup grid and result in inoperability. Since it is necessary to maintain the close spacing between the filament and the cathode cup in order to maintain adequate control of electron emission and satisfy NEMA requirements on focal spot, it will be appreciated that the welding problem cannot be resolved by simply enlarging the slot 26 because the cathode cup 12 acts as a grid to control electron emission from the filament.

Applicants have solved the above problem of welding of a filament to a cathode cup by devising a new cathode cup structure in which the upper portion of the cathode cup 16 is made from or covered with a non-weldable material. In the prior art structures, a cathode cup was typically manufactured of an alloy of molybdenum containing titanium, zirconium and carbon, an alloy commonly referred to as TZM. The helical filament wire is typically a tungsten wire which is doped with aluminum, potassium and calcium. TZM is a well known material for use in x-ray tubes since it has good high temperature strength, thermoconductivity and work function. Furthermore, the TZM can be brazed to a high temperature resistant support arm using suitable brazing material such as that commonly referred to as "Hastelloy". A more detailed description of suitable brazing. compounds for TZM is given in U.S. Pat. No. 4,187,442 issued Feb. 5, 1980 and assigned to General Electric Company.

In a preferred embodiment of the present invention, the upper section 16 of the cathode cup 12 is formed of graphite. The graphite is typically 60% crystalline carbon, obtained by heat-treatment at between 2500 and 3000 C, having the same bonding chains as diamond, and 40% amorphous carbon with bulk density at about 1.85 gram/cc. The graphite section is brazed to the TZM section while both sections are blanks and the cup is then machined to an appropriate configuration of the desired shape for a cathode cup. Since the standoffs must be spotwelded to the cathode cup, it is not practical to form the entire cathode cup from the same graphite material. Accordingly, only the upper surface 16 is formed of graphite while the lower section 14 is formed of TZM. The upper section 16 is bonded to the lower section 14 using a brazing compound of either platinum or zirconium. A typical bonding process involves placing a platinum washer on an upper surface of the section 14, positioning the graphite portion 16 on top of the platinum washer, and then placing the combination into an oven for a period of five minutes at 1,800° Celsius to allow the platinum to melt and form a brazed joint between the TZM base 14 and the graphite upper section 16.

Preferably, the surface of the graphite portion 16 of the cathode cup 12 is coated with a thin layer of pyroltic carbon of a few microns thick in order to provide a dust free surface on the graphite. A coated thickness of from 5 to 20 microns is considered to be adequate.

In an alternate embodiment of the invention, the cathode cup section 16 is formed of a silicon carbide graphite composition. This composition is produced by impregnation of a porous electrographite with molten silicon with subsequent conversion of the silicon to silicon carbide. Since the silicon has similar electrical and thermal properties to graphite and provides a relatively dust free surface, this composition eliminates the need for pyrolytic carbon coating of the graphite surface.

An alternate solution to the above welding problem, while not considered to be a preferred embodiment, is to coat a TZM cathode cup structure with a pyrolytic carbon coating wherein the pyrolytic carbon coating is of sufficient thickness to protect the underlying TZM structure such that welding between the filament and cathode cup will not occur. In this regard, it is proposed that the coating over TZM may be implemented by ion implantation, chemical vapor deposition or plasma assisted coating.

It will be recognized that each of the embodiments described herein utilizes a non-weldable material for the upper section 16 in order to provide an electrically conductive cup structure which will enable control of the electron emission from a filament while at the same time preventing welding of the filament to the cathode cup structure.

What is claimed is:

1. In an electronic tube having a relatively high-voltage developed on a cathode cup for generating and controlling an electron beam, an improved cathode cup comprising:

a base formed of a weldable metal; and a cup shaped member having an exposed upper surface, said member being formed of an electrically conductive, non-weldable material bonded to said base.

2. The cathode cup of claim 1 wherein said upper surface comprises a formed section of the cup brazed to said base.

3. The cathode cup of claim 2 wherein said formed section comprises graphite.

4. The cathode cup of claim 3 wherein said base comprises a material composition of molybdenum, titanium, zirconium and carbon.

5. The cathode cup of claim 4 wherein said base is brazed to said formed section using platinum brazing material.

6. The cathode cup of claim 4 wherein said base is brazed to said formed section using zirconium brazing material.

7. The cathode cup of claim 1 wherein said upper surface comprises a coating of pyrolytic carbon.

8. The cathode cup of claim 2 wherein said formed section comprises a silicon carbide graphite composite material.

9. A method for forming a composite cathode cup for a high-voltage electronic tube comprising the steps of:

forming a support base for the cup of a weldable material;

forming an upper section of a non-weldable, electrically conductive material; and bonding said upper section to said base.

10. The method of claim 9 and including the further step of machining the composite cup to a desired shape.

11. The method of claim 10 wherein said bonding step comprises brazing of the upper section to the base using a platinum or a zirconium brazing material.

12. A cathode for an electron tube comprising:

an electrically conductive base member formed of a material suitable for welding to a support structure; and a cup member of an electrically conductive, non-weldable material having an upper surface formed for supporting an electrically energized filament in spaced apart relationship, said cup member having a lower surface adapted for bonding to said base member.

13. The cathode of claim 12 wherein said upper surface of said cup member has a slot formed thereacross, the filament being positioned in said slot.

* * * * *